United States Patent [19]

Kawai et al.

[11] Patent Number: 5,000,708

[45] Date of Patent: Mar. 19, 1991

[54] PROPELLER DRIVING SYSTEM FOR MARINE PROPULSION UNIT

[75] Inventors: Takaji Kawai; Kenichi Handa, both of Hamamatsu, Japan

[73] Assignee: Sanshin Kogyo Kabushiki Kaisha, Hamamatsu, Japan

[21] Appl. No.: 462,793

[22] Filed: Jan. 10, 1990

[30] Foreign Application Priority Data

Jan. 11, 1989 [JP] Japan ..... 1-4048

[51] Int. Cl.[5] ..... B63H 21/28

[52] U.S. Cl. ..... 440/75

[58] Field of Search ..... 440/49, 51, 75, 76, 440/78, 82, 83, 86, 900

[56] References Cited

U.S. PATENT DOCUMENTS

| | | | |
|---|---|---|---|
| 3,556,041 | 1/1971 | Shimanckas | 440/86 |
| 4,302,196 | 11/1981 | Blanchard | 440/86 |
| 4,689,027 | 8/1987 | Harada et al. | 440/75 |

*Primary Examiner*—Joseph F. Peters, Jr.
*Assistant Examiner*—Jesûs D. Sotelo
*Attorney, Agent, or Firm*—Ernest A. Beutler

[57] ABSTRACT

A marine outboard drive lower unit forward, neutral, reverse transmission including an arrangement for taking forward and reverse thrust directly from the propulsion shaft by pairs of thrust bearings that act on oppositely facing thrust surfaces formed by the propeller shaft. A single coil compression spring preloads both of the bearings.

11 Claims, 2 Drawing Sheets

PROPELLER DRIVING SYSTEM FOR MARINE PROPULSION UNIT

BACKGROUND OF THE INVENTION

This invention relates to a propeller driving system for a marine propulsion unit and more particularly to an improved arrangement for taking the thrust from a propulsion shaft of a forward, reverse transmission of a marine propulsion unit.

Conventionally, the propulsion shaft such as a propeller shaft of a marine propulsion unit such as an outboard motor or the outboard drive portion of an inboard/outboard drive includes a forward, neutral, reverse transmission so that the propulsion shaft can be selectively driven in forward and reverse directions. Such transmissions normally use a bevel gear reversing transmission that includes a driving bevel gear that is coupled to the drive shaft of the outboard drive unit and which drives a pair of counterrotating bevel gears that can be selectively coupled to the propulsion shaft for driving the propulsion shaft in forward or reverse directions.

Because of the forward and reverse drive of the propulsion shaft, it is necessary to insure that the lower unit has thrust bearings that operate to take the thrust in both forward and reverse directions. In one type of arrangement, the driven bevel gears are rotatably supported on a gear mounting shaft that is axially separate from but splined to the propulsion shaft. Alternatively, arrangements have been provided in which both the forward and reverse driven gears are journaled on a single propulsion shaft and adapted to be clutched to the shaft for driving it in forward or reverse directions. Either arrangement, however, presents some problems in connection with the taking of the thrust adequately in both directions and supporting all of the elements. For example, with the first mentioned type of mechanism employing a separate gear mounting shaft, the gear mounting shaft cannot be long enough to secure sufficient axial support length for each gear so as to be loaded stably and also to secure a sufficient span between the gear mounting shaft bearings to avoid shaft inclination caused by play in the bearings. Such shaft inclination can have adverse effects on the gear contact of the transmission. Also, the splines are apt to be worn by the action of shifting from forward to reverse and vice versa.

With the other type of mounting arrangement wherein the gears are mounted on a single propulsion shaft, it is difficult to provide accurate dimensional accuracy between both thrust transmitting portions so that the resulting play will cause longitudinal movement of the propeller shaft, reduced durability of the bearings and so forth. In addition, such arrangements can introduce noise to the system which is a forerunner of wear.

It is, therefore, a principal object of this invention to provide an improved propeller driving system for a marine propulsion unit having an improved bearing and thrust arrangement.

It is a further object of this invention to provide an improved arrangement for taking the thrust from a propeller shaft of the type that mounts both the forward and reverse driving gears and wherein the thrust bearings are adequately preloaded.

It is a further object of the invention to provide an improved bearing arrangement for a propulsion shaft of a marine drive lower unit wherein forward and reverse thrusts are taken and the bearings are preloaded by means of a spring.

SUMMARY OF THE INVENTION

This invention is adapted to be embodied in a forward, reverse drive transmission for the lower unit of a marine outboard drive that is comprised of a lower unit housing. A drive shaft is journaled for rotation within the lower unit housing and a driving gear is affixed for rotation with the drive shaft. A propulsion shaft is journaled for rotation within the lower unit housing for rotation about an axis that extends transversely to the axis of the drive shaft. A pair of counterrotating driven gears are driven in opposite directions from the driving gear and are supported for rotation relative to the propulsion shaft. Clutch means are incorporated for selectively coupling either of the driven gears for rotation with the propulsion shaft for driving the propulsion shaft in selected forward or reverse directions. A pair of oppositely facing thrust surfaces are formed on the propulsion shaft and thrust bearing means are interposed between each of the thrust surfaces and the lower unit housing for transmitting forward and reverse driving thrusts from the propulsion shaft to the lower unit housing. Biasing means are provided for preloading the thrust bearing means.

DETAILED DESCRIPTION OF THE PREFERRED EMBODIMENT

Figure 1:
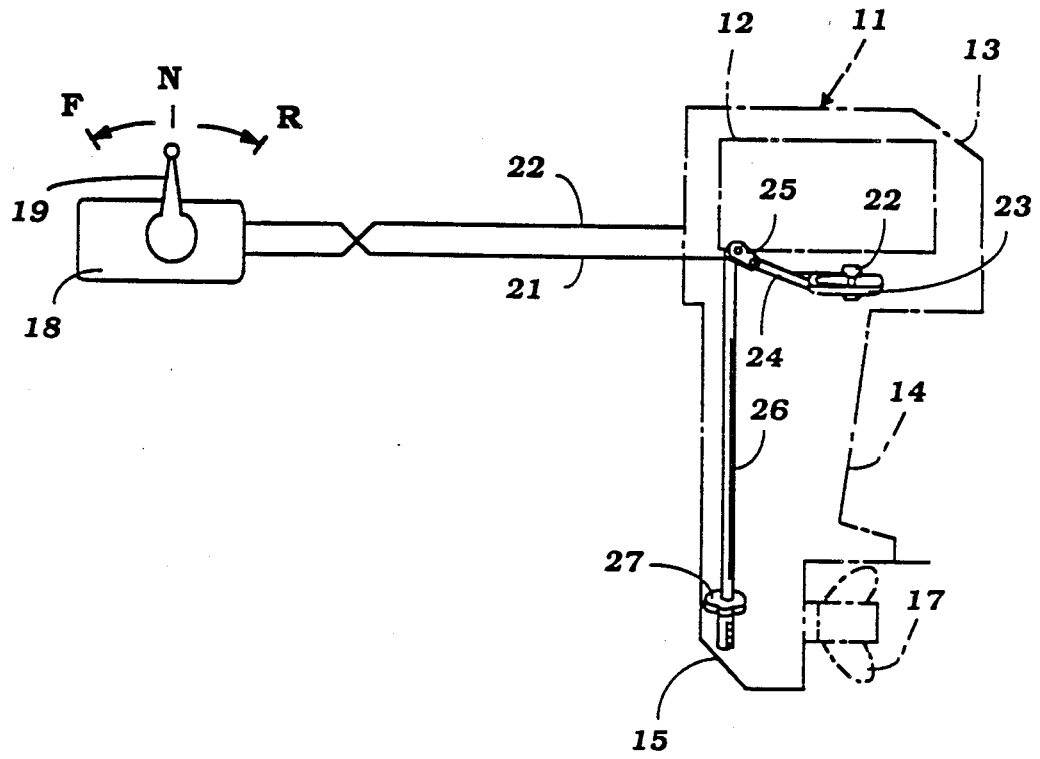
FIG. 1 is a partially schematic side elevational view of an outboard motor constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that the invention may be equally as well practiced with the outboard drive unit of an inboard/outboard drive. Such units are generally referred to herein as marine propulsion units or lower units thereof of outboard drives.

The outboard motor 11 includes a power head that incorporates an internal combustion engine, which may be of any known type and is shown schematically at 12 and that is contained within a protective cowling, shown in phantom and identified by the reference numeral 13. As is typical with outboard motor practice, the engine 12 is supported so that its output shaft rotates about a vertically extending axis. This output shaft, (which is not shown), is coupled to a drive shaft, to be described later, that is supported for rotation about a vertically extending axis within a drive shaft housing 14. A lower unit 15 depends from the drive shaft housing 14 and contains a forward, neutral, reverse transmission, indicated generally by the reference numeral 16 in FIGS. 2 and 3, for driving a propeller 17 in selective forward and reverse directions.

The transmission 16 is controlled by means of a remote operator 18 having a shift lever 19 that is connected by means of a pair of bowden wire cables 21 and 22 to a shift actuating mechanism 23. The shift actuating mechanism 23 is contained within the power head of the outboard motor 11 and cooperates with a slot 23 in a shift lever 24 and bellcrank 25 for rotating a shift rod 26 in selected forward and reverse directions as noted by the letters F, N and R. A cam 27 is affixed to the lower end of the shift rod 26 for effecting shifting motion in a manner which will be described.

Figure 2:
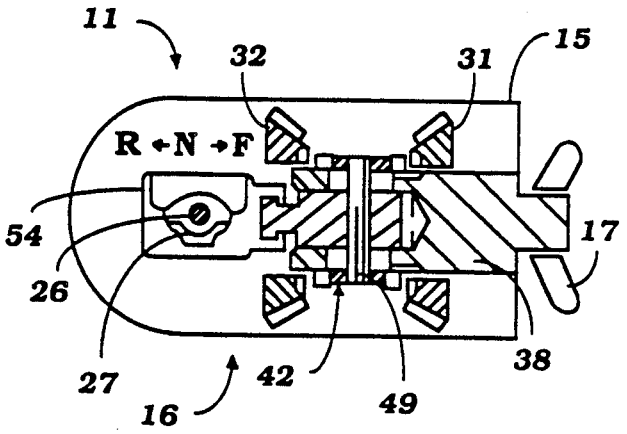
FIG. 2 is a partially schematic cross-sectional view taken along a horizontal plane showing the forward, reverse transmission.
Figure 3:
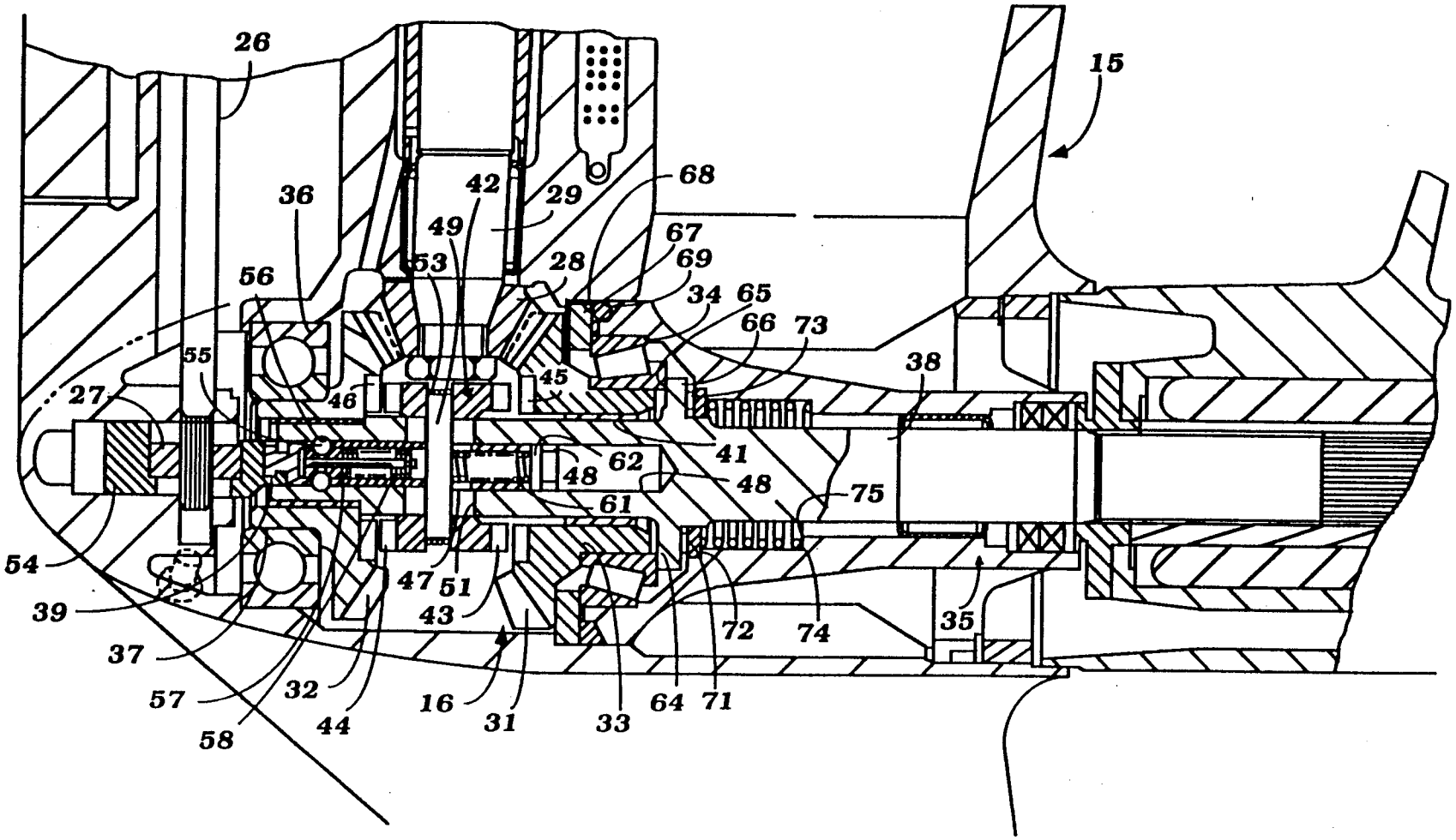
FIG. 3 is an enlarged cross-sectional view of the lower unit taken along a vertically extending plane.

Referring now primarily to FIG. 3, although the construction of the transmission 16 may also be understood by reference to FIG. 2, it will be seen that a driving bevel gear 28 is affixed to a lower end of the drive shaft 29 previously referred to. The driving bevel gear 28 drives a pair of diametrically opposed driven bevel gears 31 and 32, which are the forward drive and reverse drive gears, respectively. The forward drive gear 31 has a hub portion 33 that is journaled by means of a thrust bearing, indicated generally by the reference numeral 34, and which is contained in the forward end of a bearing carrier, indicated generally by the reference numeral 35. The bearing carrier 35 is suitably affixed within a horizontally extending bore formed in the outer housing of the lower unit 15.

The reverse driven bevel gear 32 is journaled by means of an anti-friction ball bearing 36 that engages a hub portion 37 of the driven bevel gear 32 and which is supported in a suitable manner in the lower unit housing.

A propulsion or propeller shaft 38 has a forward portion that is received in the hub 37 of the driven bevel gear 32 with an anti-friction bearing or bushing 39 interposed therebetween. In a similar manner, the hub 33 of the forward driven bevel gear 31 rotatably journals an intermediate portion of the propeller shaft 38 with an interposed bushing 41.

A dog clutching sleeve, indicated generally by the reference numeral 42, has a splined connection with the forward portion of the propeller shaft 38 and is disposed between the bevel gears 31 and 32. The dog clutching sleeve 42 has dog clutching teeth 43 and 44, respectively, which face corresponding dog clutching teeth 45 and 46 of the bevel gears 31 and 32, respectively. Hence, when the dog clutching sleeve 42 is slid axially along the propeller shaft 38, in a manner to be described, in the forward drive position (rearwardly), the driven bevel gear 31 will be rotatably coupled to the propeller shaft 38 so as to drive the propeller 17 in a forward drive condition. When the dog clutching sleeve 42 is slid forwardly, its dog clutching teeth 44 will engage the dog clutching teeth 46 of the driven bevel gear 32 and the propeller shaft 38 and propeller 17 will be driven in a reverse drive condition.

In order to effect the aforenoted shifting operation, a shift plunger 47 is slidably supported within a bore 48 formed in the forward end of the propeller shaft 38. A shift pin 49 couples the shift plunger 47 to the dog clutching sleeve 44. It should be noted that there is provided an elongated slot 51 in the propeller shaft 38 so as to permit axial movement of the pin 49 while, at the same time, insuring that the dog clutching sleeve 42 rotates with the propeller shaft 38. A torsional spring 53 encircles a groove formed in the dog clutching sleeve 42 so as to hold the pin 49 in position, as is well known in this art.

The shift plunger 47 is coupled to a shift actuating cam 54 that is supported in the forward end of the lower unit housing and with which the shift cam 27 operates. When the shift cam 27 is rotated, the shift actuating cam 54 and, accordingly, the shift plunger 47 will be reciprocated. There is provided a well known connection between the shift cam 54 and the shift plunger 47 so that these elements will reciprocate with each other so that the plunger 47 may rotate relative to the shift actuating cam 54.

A detent mechanism comprised of a plurality of detent balls 55 are contained within the forward portion of the shift plunger 47 and are normally urged into engagement with detent recesses 56 of the propeller shaft 38 by means of a spring loading mechanism 57 of a known type including a apring 58 for holding the shift mechanism or transmission 16 in its neutral position. If desired, this detent mechanism may cooperate so as to provide sufficient preload so that the shift rod 26 will torsionally wind up before the shifting is accomplished. As a result, there will be snap action of the transmission when shifting into forward or reverse conditions.

A cushioning mechanism is incorporated between the shift plunger 48 and the dog clutching sleeve 42 for cushioning the loading when shifting into forward drive condition. This cushioning mechanism includes a coil compression spring 61 that is loaded between the pin 49 and a pin 62 that is affixed to the shift plunger 47.

Since the propeller 17 is driven in both forward and reverse directions, it is necessary to transmit both forward and reverse driving thrusts from the propeller shaft 38 to the lower unit 15. For this purpose, there is provided a thrust shoulder 64 on the propeller shaft 38 adjacent the thrust bearing 34. This thrust shoulder 64 has a forwardly facing forward thrust surface 65 and a rearwardly facing reverse thrust surface 66 The forward thrust surface 65 bears against the inner race of the thrust bearing 34 and hence transmits forward driving thrust to the thrust bearing 34. These thrusts are then transmitted to a thrust washer 67 that is clamped between the forward end of the bearing carrier 35 and a shoulder 68 of the lower unit housing. An 0-ring seal 69 is provided around the bearing carrier 35 at the forward end for sealing purposes.

The rear or reverse face 66 of the thrust shoulder 64 bears against a thrust bearing 71 which, in turn, reacts against a thrust washer 72 that is engaged with a forwardly facing shoulder 73 of the bearing carrier 35.

In order to preload the thrust bearings 34 and 71, a coil compression spring 74 is provided in a counterbore of the bearing carrier 35 and reacts against a shoulder 75 thereof and against the thrust washer 72. As a result, both the thrust bearings will be preloaded by the coil compression spring 74 and hence any looseness or noise in the system will be effectively eliminated. In addition, there will be sufficient preload on these bearings even when traveling at low speeds so as to avoid any play in the system. Also, since the thrust surfaces 65 and 66 are quite close to each other, dimensional accuracy and play can be minimized.

It should also be noted that the thrust between the bevel gear 28 and the forward drive bevel gear 31 will tend to resist the forward driving thrust on the thrust bearing 34 and hence the overloading of this bearing will be reduced.

It should be readily apparent from the foregoing description that a very effective propeller driving system is provided for marine propulsion units wherein tolerances can easily be maintained and wherein the thrust bearings will be adequately preloaded and noise minimized. Although an embodiment of the invention has been illustrated and described, various changes and modifications may be made without departing from the spirit and scope of the invention, as defined by the appended claims.

We claim:

1. A forward, reverse drive transmission for the lower unit of a marine outboard drive comprising a lower unit housing, a drive shaft journaled for rotation within said lower unit housing, a driving gear affixed for rotation with said drive shaft, a propeller shaft journaled for rotation within said lower unit housing for rotation about an axis extending transversely to the axis of said drive shaft, a pair of counterrotating driven gears driven in opposite directions from said driving gear and supported for rotation relative to said propeller shaft, clutch means for selectively coupling either of said driven gears for rotation with said propulsion shaft for driving said propulsion shaft in selected forward or reverse directions, a pair of oppositely facing thrust surfaces formed on said propeller shaft, thrust bearing means interposed between each of said thrust surfaces and said lower unit housing for transmitting forward and reverse drive thrust to said lower unit housing, and biasing means for preloading said thrust bearing means.

2. A forward, reverse driving transmission as set forth in claim 1 wherein the biasing means comprises a spring.

3. A forward, reverse driving transmission as set forth in claim 2 wherein the spring comprises a coil spring surrounding the propeller shaft.

4. A forward, reverse driving transmission as set forth in claim 1 wherein the thrust surfaces are spaced from each other in an axial direction relative to the propulsion shaft less than the spacing between the driven gears.

5. A forward, reverse driving transmission as set forth in claim 1 wherein the thrust bearing means comprises a pair of thrust bearings each acting against a respective one of the thrust surfaces.

6. A forward, reverse driving transmission as set forth in claim 5 wherein the biasing means preloads both of the thrust bearings.

7. A forward, reverse driving transmission as set forth in claim 6 wherein the biasing means comprises a spring.

8. A forward, reverse driving transmission as set forth in claim 7 wherein the spring comprises a coil spring surrounding the propeller shaft.

9. A forward, reverse driving transmission as set forth in claim 1 further including a bearing carrier for rotatably journaling the propeller shaft and supporting the thrust bearing means.

10. A forward, reverse driving transmission as set forth in claim 9 wherein the thrust bearing means are axially spaced apart bearings.

11. A forward, reverse driving transmission as set forth in claim 10 wherein the thrust surfaces are formed by opposite facing surfaces of a single thrust shoulder formed integrally on the propulsion shaft.

* * * * *